US005294126A

United States Patent [19]

Armstrong, III

[11] Patent Number: 5,294,126

[45] Date of Patent: Mar. 15, 1994

[54] GOLF SWING AID

[75] Inventor: Walter E. Armstrong, III, Maitland, Fla.

[73] Assignee: Wally Armstrong Golf, Inc., Paoli, Pa.

[21] Appl. No.: 974,887

[22] Filed: Nov. 12, 1992

[51] Int. Cl.[5] ..... A63B 69/36

[52] U.S. Cl. ..... 273/187.2; 273/189 R; 273/187.6

[58] Field of Search ..... 273/186.2, 187.2, 187.4, 273/190 R, 188 R, 189 R, 187.5; 223/85

[56] References Cited

U.S. PATENT DOCUMENTS 1,655,092 1/1928 Davis ..... 273/189 R 3,565,261 2/1971 Recla ..... 223/85 X 3,702,166 11/1972 Jaffe ..... 223/85

4,145,054 3/1979 Stewart ..... 273/186.2

*Primary Examiner*—George J. Marlo

*Attorney, Agent, or Firm*—Cislo & Thomas

[57] ABSTRACT

A golf swing aid comprises a shaft with a grooved undersurface for engagement to a golf club and an extending tab to indicate to the golfer the proper cocking and uncocking of his wrists during a golf swing. The golf swing aid has at opposite end curved portions shaped to allow the golfer to pass his arms through and restrict his arms within for putting practice. Additionally, the extending tab has an associated arrow that is used with a ruler to aid the golfer in putting straight.

4 Claims, 4 Drawing Sheets

Fig. 5.
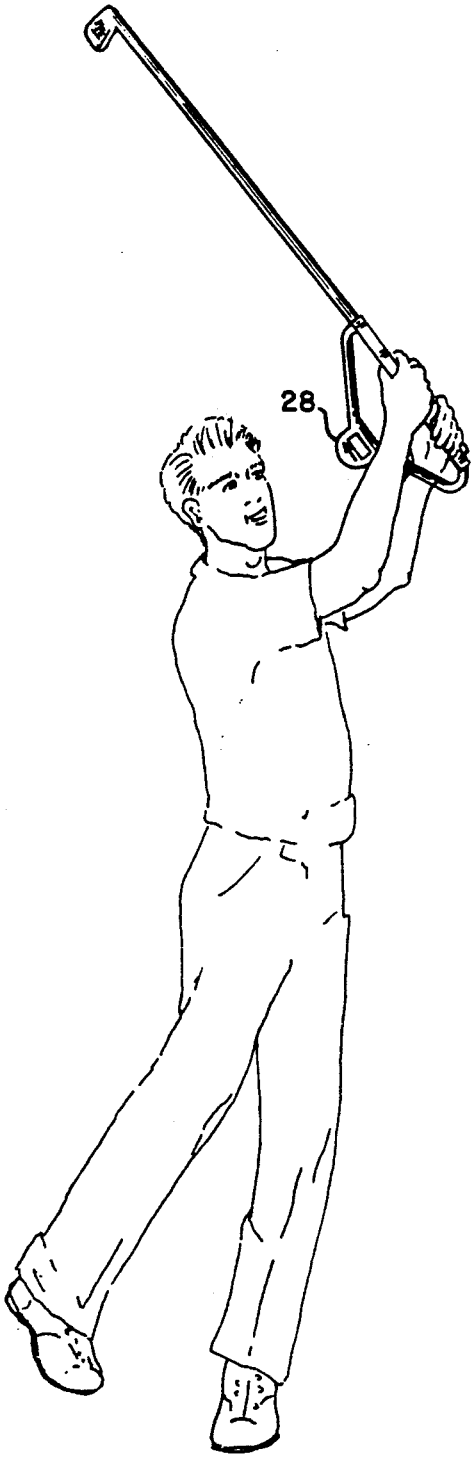
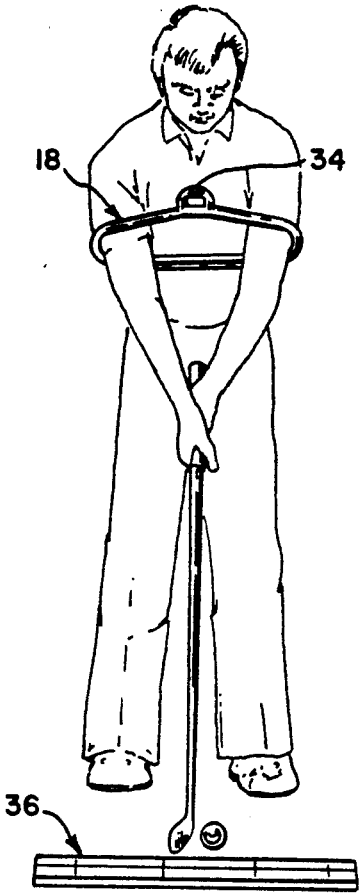
Fig. 8.

GOLF SWING AID

BACKGROUND OF THE INVENTION

This invention pertains to a golf swing training aid. In the past many devices have been suggested to either improve a golf swing or a golfer's putting and chipping swing, but no single aid has heretofore target improvements for both swinging and putting.

Teaching aids available to correct a golfer's swing use techniques that alert the golfer to the improper cocking and uncocking of his wrists. If the wrists are cocked back on the backswing and then uncocked on the downswing and continue cocking back on the follow-through the club head of the golf club will have an added increment of speed over the base speed that the club would have had without the cocking action. When a player knows how to add velocity of the swing of his wrists to the velocity of his arm swing, an advantage is gained by being able to hit the golf ball farther.

Prior aids available to correct a golfer's putting stroke use means to stabilize the arms therefore allowing the golfer to learn the best stable position when using his putter.

A preliminary patentability search at the U.S. Patent and Trademark Office was directed to a field of search encompassing classes 273/186R, 183A-183E, 186R, A-186E, 187R, 187A, 187B, 191R, 191A, 191B, 192. The patents listed below were uncovered by the search.

| U.S. Pat. No. | NAME OF INVENTOR | DATE OF ISSUE |
|---|---|---|
| 5,009,426 | R.W. Cox | April 23, 1991 |
| 4,984,801 | J.A. Deback | January 15, 1991 |
| 4,145,054 | P.D. Stewart | March 20, 1979 |
| 4,023,812 | W.R. Lorang | May 17, 1977 |
| 3,918,712 | J.B. Trask | November 11, 1975 |
| 3,672,682 | S. Yanagidaira | June 27, 1972 |

Brief descriptions of the patents uncovered by the search are given below.

Cox U.S. Pat. No. 5,009,426

This patent is directed to a device comprising a guide bar having a substantially semi-circular configuration, a releasable clamp assembly provided at one end of the guide bar for securely receiving an upper end of a golf club handle, and a retaining clip provided at the second end of the guide bar for receiving a lower end of a golf club handle. The guide bar has a plurality of through openings in which a stop bar is removably bolted. The stop bar engages the upper face of the user's trailing forearm to limit pivotal movement of the club shaft relative to the user's trailing forearm. The stop bar is adjustable and may be set to limit the relative pivotal movement between the forearm and the club shaft to approximately ninety degrees. During a stroke, the wrist is substantially straight at the bottom of the stroke but is bent at the backswing and the follow-through positions. The guide means enables this pivoting of the wrist to be controlled by maintaining the portion in contact with the trailing forearm.

Deback U.S. Pat. No. 4,984,801

This patent is directed to an apparatus that permits the user to both exercise and develop the right muscles used in the user's golf swing as well as developing a geometrically correct swing. The apparatus is a structural member attached to a golf handle. The member may be curved or made up of L shaped members that are clamped to the handle. If L shaped members are used, they are slidably connected to each other. Weights suspend from the member so that they are directly below the golfer's grip. If a curved member is used, a means for adjusting weights is provided so as to locate the weights properly. The weights are suspended from the member by a single member or a member made up of the two parts: two members that permit one to telescopically slide into the other. When the invention is used, weights swing back and forth naturally while the user controls the golf club by a mechanically correct swing. The golfer swings the golf club and apparatus back to a point that the club is parallel to the ground and the club head is toe up and then forward to a point the club is again parallel to the ground and the club is toe up. This is repeated until this part of the golf swing becomes natural to the golfer.

Stewart U.S. Pat. No. 4,145,054

This patent is directed to a golf swing training aid. The golf training aid is adapted for use with a variety of golf clubs and comprises a clamp and socket member having a seat for adjustably and demountably receiving the shaft of a golf club and a socket for receiving one end of a rod. The rod may be straight or arcuate shaped. The rod is attached to the golf club shaft in such a manner that it forms a laterally-spaced, angularly-directed bifurcation of the shaft. The rod is of predetermined length and its angle of attachment is such as to cause it to remain out of contact with the forearms during a properly executed swing, but to contact one or the other of the forearms during an improperly executed swing thus advising him of his error.

Lorang U.S. Pat. No. 4,023,812

This patent is directed to a golf swing wrist action training apparatus. The training apparatus comprises a leg having an upper end that contacts the forearm of the golfer and a lower end that abuts the shaft of a golf club, a clevis that abuts the shaft of the golf club, and is secured to the attaching end of the leg by bolts and nuts, and a signal device on the upper end of the leg to emit a clicking sound when engaged by the forearm of the golfer. The signal devise advises the player when he has properly cocked his wrists, when he has properly uncocked his wrists, and also when he relaxes his wrists and lets them uncock inadvertently.

Trask U.S. Pat. No. 3,918,712

This patent is directed to a golf swing training device. The training device comprises a flexible cable having one end attached to a strap adapted to fit around the handle of a golf club, and an end tip disposes on the free end of the flexible cable. The device produces contact with the forearm of the wearer in the event of an improper swing.

Yanagidaira U.S. Pat. No. 3,672,682

This patent is directed to a golf putting training apparatus. The training apparatus comprises an arm stabilizer having formed at both ends thereof curvatures to adapt to fit on the second joints of the respective arms of the golfer. When the device is fitted to the second joints of the golfer's arms, the golfer practices his putting with his fixed or stabilized arms separated from his body. By repeating this practice, the golfer can learn the most stabilized putting posture to put the ball into the hole.

The features identified above as being desirable for improving a golf swing or a golfer's putting stroke are all provided by the present invention. For the golfers who want to improve different aspects of their game, they would have to carry more than one aid at a time. Carrying a variety of aids is not only cumbersome to the golfer who chooses to walk his bag the length of the course, but also can be confusing to the golfer, trying to muster the proper stroke.

SUMMARY OF THE INVENTION

The golf swing aid of the invention comprises an intermediate shank portion with an engagement surface for accommodating the shaft of a golf club and having curved portions defining an opening, with the intermediate shank portion, of sufficient size to allow the golfer to pass his arms through and restrict his arms within for putting practice. The curved portions are connected to an extending tab portion which has an associated arrow that is used with a ruler to assure that the golfer is putting straight.

The golf swing aid additionally allows the golfer to determine whether or not he has properly cocked and uncocked his wrists by the extending tab portion of the golf aid signaling the correct location or positioning of the forearm of the golfer, in the event of a proper swing. In addition, by restricting the golfer's arms and having him line up the arrow, located in the extending tab portion of the golf aid, to a ruler or straight member on the ground, the golfer can learn the natural and most stabilized putting posture best suited to hole out a ball with his putter.

The advantage of the golf aid of this invention is that it combines various golf training techniques into one device. It positively indicates in the mind of the golfer that he has the proper wrist movement during the backswing, downswing, and follow-through. The golfer rapidly learns the best stable posture for golf putting. The golf aid is applicable to all categories of golf clubs, irons, drivers, pitching wedge and the putter. It engages a conventional club shaft without having to have means to secure it to the club and without causing any damage to it. It can be carried conveniently by the golfer in his golf bag or cart.

BRIEF DESCRIPTION OF THE DRAWINGS

FIG. 5 is a perspective view of the golfer executing the golf swing in FIG. 4, and showing the end of the follow-through with the wrists cocked and the extending tab portion of the golf aid of the invention in contact with the leading forearm of the golfer;

FIG. 8 is a perspective view showing a golfer using a putter and lining up the putter with the golf aid of FIG. 1 and a straight member such as a ruler on the ground.

DESCRIPTION OF THE PREFERRED EMBODIMENTS

By using the golf swing aid 18, the golfer both learns how to properly cock and uncock his wrists during a properly executed golf swing and further develops the correct stance to more accurately align his chipping and putting shots.

Figure 1:
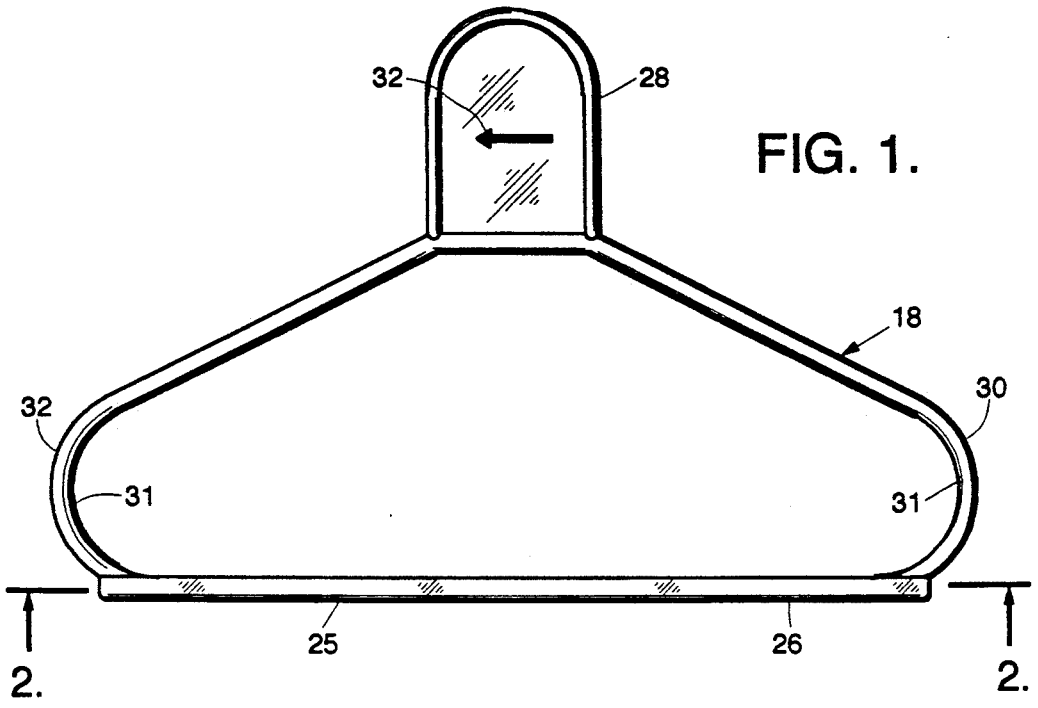
FIG. 1 is a side elevational view of the golf aid of the present invention.

Referring now to the drawings wherein like reference numerals refer to like and corresponding parts throughout, golf swing aid 18 comprises a hanger like member having an intermediate shank portion 26, as shown in FIG. 1. A first curved portion 30 and a second curved portion 32 are connected to opposite ends and lie in the same plane of the intermediate shank portion 26. Connected between the termini of first curved portion 30 and the second curved portion 32 is extending tab portion 28, which extends away from the intermediate shank portion 26. It will be observed in FIG. 1 that the extending tab portion 28 is aligned in the same plane and centrally located about an axis to the intermediate shank portion 26.

Figure 2:
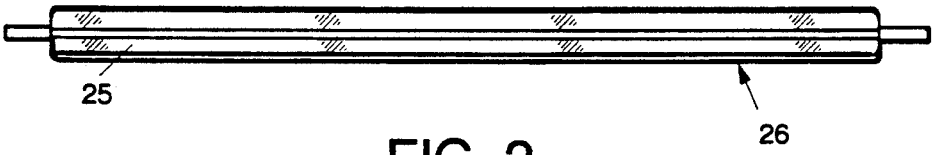
FIG. 2 is a section on line 2—2 of FIG. 1 showing the golf club association groove of the golf aid of the present invention.
Figure 3:
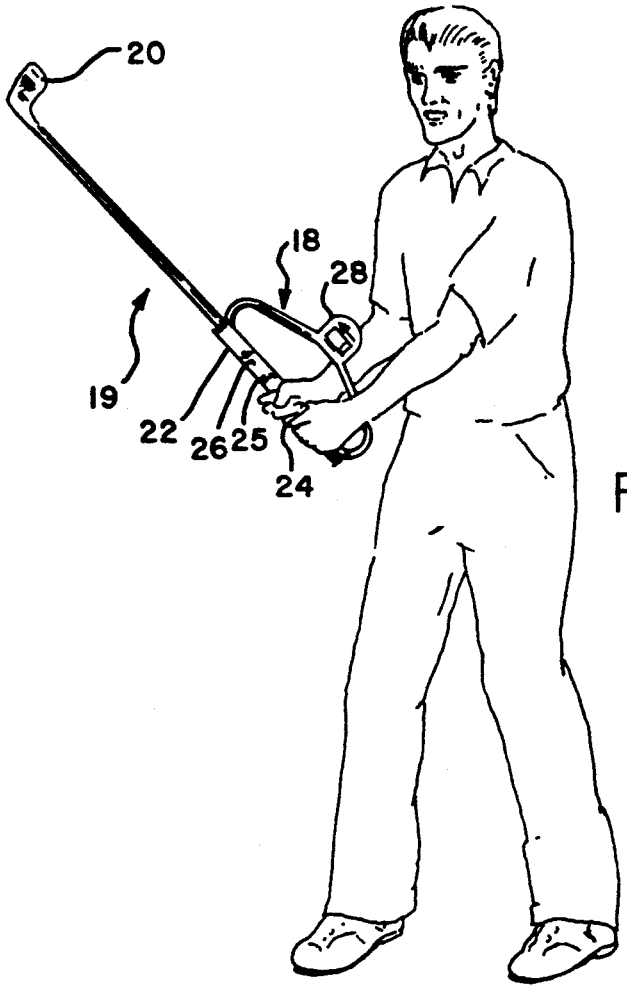
FIG. 3 is a perspective view of a golfer using a club equipped with the golf aid shown in FIGS. 1 and 2, particularly showing the hands at hip level during the backswing with the wrists cocked and an extending tab portion of the golf aid in contact with the leading forearm of the golfer.

Referring to FIGS. 2 and 3, it will be seen that the undersurface 25 of intermediate shank portion 26, is grooved or channeled so as to be adapted for close engagement associated with the extended shaft 22 of golf club 19.

As seen in FIG. 1, the golf swing aid 18 may be fabricated from various structural materials, preferably from flexible plastic with rounded edges as at 31, so that in use it cannot scratch or bruise the golfer, and can be manufactured by an inexpensive molding process. While the golf swing aid 18 has been described in its preferred form as being flexible, it may be made rigid.

The golf swing aid 18 is basically an oversized coat hanger-type device which has a transparent projecting tab which projects in the same plane of where a coat hanger hook would be positioned. On the longest side of the device, a curved golf club engagement section is utilized so as to align the device along the handle of a golf club.

The herein described golf swing aid 18 is adapted for use with any style or type of golf club 19. Such clubs comprise the usual head 20, extended shaft 22, and grip or handle 24 as illustrated in FIG. 3. As considered herein, the grip or handle 24 is deemed to be part of the extended shaft 22 and is to be understood within the meaning of that term. Referring to FIG. 3, it is seen that when the undersurface 25 of intermediate shank portion 26 of golf aid 18 engages the extended shaft 22, it is aligned with and coincident to the axis of the extended shaft 22. This determines the angle at which the extending tab portion 28 lies to the extended shaft 22.

Figure 4:
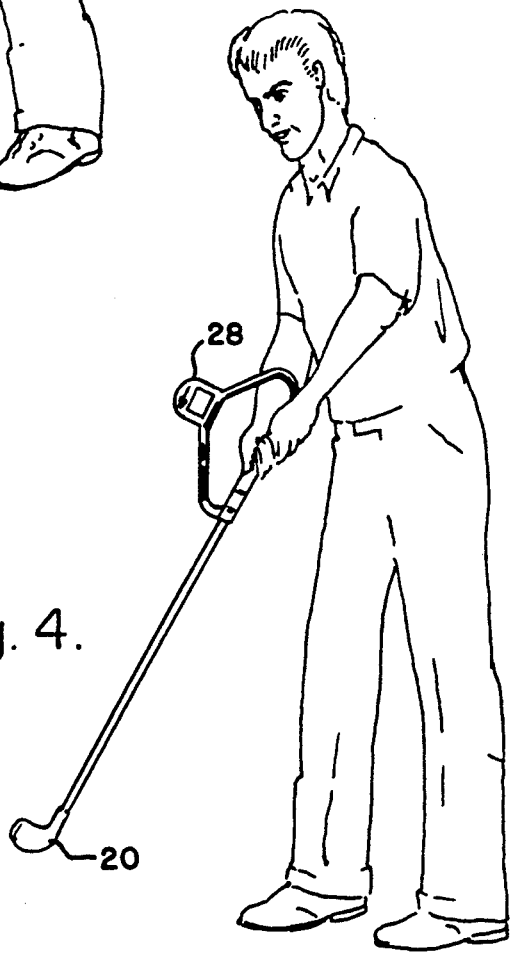
FIG. 4 is a perspective view of the golfer in carry through of the golf swing shown in FIG. 3, just after the position of the hands have passed the hip level in the downswing, with the wrists uncocking and the extending tab portion of the golf aid not in contact with the leading forearm of the golfer.

Three golf swing positions that can be used with the golf swing aid 18 are considered in the drawings. 3, 4 and 5, diagrammatically represent a golfer facing the reader, and illustrate the conditions wherein the wrists are cocked FIG. 3 and FIG. 5, and the wrists uncocked FIG. 4. For purposes of clarity, the backswing in FIG. 3 is not made as high as a normal backswing. As shown in FIG. 3, the extended tab portion 28 is in contact with the golfer's leading forearm with the wrists properly cocked.

On the downswing, the tendency of inexperienced golfers is to keep the wrists cocked which force the hands through ahead of the hips which results in the extending tab portion 28 remaining in contact with the golfer's leading forearm, indicating that the club head 20 has been forced through ahead of the hands. FIG. 4 shows the proper swing at impact, and it will be seen that the extending tab portion 28 is not in contact with either of the golfer's leading forearms indicating that the club shaft is more aligned with the body axis of the golfer.

On the follow-through, as shown in FIG. 5, the wrists of the golfer are once again cocked and the extending tab portion 28 is in contact with the golfer's leading forearm, signaling to the golfer that he has successfully completed the stroke.

The net effect of these various factors is to locate the extending tab portion 28 so that it will signal the golfer's leading forearm during a properly executed backswing and follow-through, as illustrated in FIG. 3 and FIG. 5, but will lie between the golfer's leading forearms and out of contact therewith during the downswing as illustrated in FIG. 4.

Figure 6:
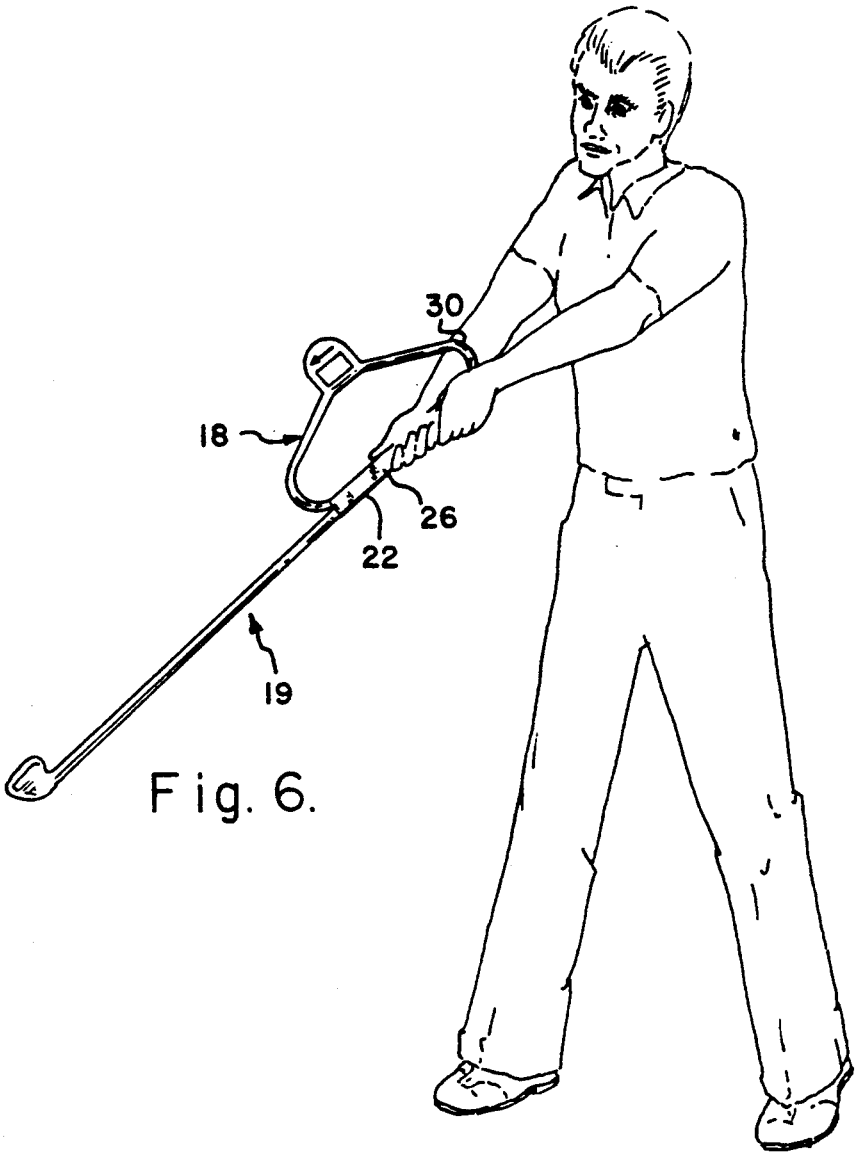
FIG. 6 is a perspective view of the golf aid of FIG. 1 showing the golfer's hands at hip level for a chip shot, the leading forearm and golf club held straight together with the curved member of the golf aid of the invention in contact with the leading forearm of the golfer.

FIG. 6 illustrates the use of the-golf swing aid 18 in chipping practice wherein the intermediate shank portion 26 engages the extended shaft 22 of the golf club 19 with the first curved portion 30 located against the golfer's leading forearm. During the golfer's chipping swing, the first curved portion 30 remains in contact with the golfer's leading forearm, producing a pendulum motion between the golf club 19 and the golfer's arms, relative to an axis drawn through the center of the golfer's body. This prevents the golfer from scooping the golf ball during the chipping swing, which occurs when the golfer breaks the golf club 19 away from the leading forearm. More accuracy is gained during a chip shot when the golfer keeps his forearm and golf club 19 held straight together, thereby producing an integral component throughout the swing.

Figure 7:
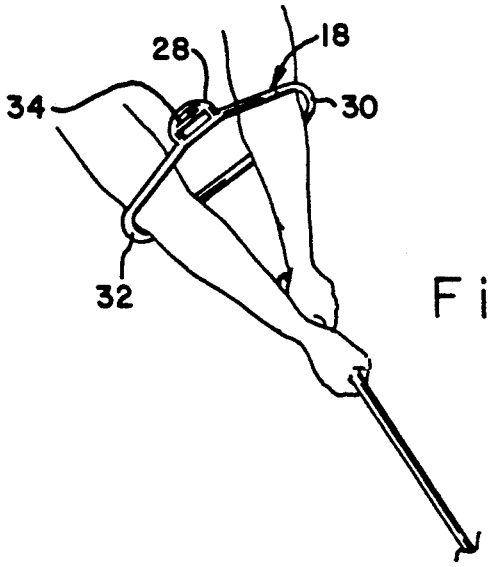
FIG. 7 is a partial perspective view of the golf aid of FIG. 1, with a golfer's arms within the open portion and contacting the curve members of the golf aid.

Best seen in FIG. 7, golf swing aid 18 comprises generally semi-circular curved portions 30 and 32 shaped as to define an opening of sufficient size to allow the golfer's arms there through and wherein an extending tab portion 28 is connected between the curved portions 30 and 32 and lies in the same plane and extends away perpendicularly from the body of the golfer. As shown in FIGS. 1 and 7, extending tab portion 28, has a cut-out portion defining an opening shaped as an arrow 34 and parallel to the intermediate shank portion 26 so that the golfer can stabilize his arms and use the arrow 34 to line up his putting shot with the hole. Obviously, an arrow decal may be used in lieu of the arrow cut-out.

Golf swing aid 18 may be used in association with a ruler or straight member 36 as shown in FIG. 8. When using the arrow 34 the golfer can learn the most stabilizing putting posture. This is accomplished by the golfer looking through and aligning the arrow 34 with the straight member 36 with the end result being that a golfer will better putt a golf ball with a high degree of success.

The golf aid of the invention is usable on any golf club, both left and right handed clubs. With the golf aid, the novice and expert alike will improve the wrist action in their swings.

The golf aid gives the golfer a means to determine the angle of a proper wrist cock, when to cock his wrists, and when to uncock them. The device provides the golfer with a signal in the form of a contacting portion of the golf aid with the golfer's leading forearm, during a properly executed backswing and follow-through. Also, the arms of the golfer may be placed through the open section of the golf aid so as to keep the golfer's arms together and encourage a pendulum-type motion between the golfer's arms and the club, thereby improving the golfer's putting stance. Additionally, the arrow positioned on the extending tab of the golf aid may be used for alignment with a collapsible ruler or straight edge, which is positioned on the ground, in front of the golfer, in the direction of the ball's intended travel.

The golf aid does not interfere with the normal swing of the club nor does it throw the club or the swing out of balance. Also, the device of the instant invention is highly useful in professional instruction, as the golf pro can accurately and demonstrably show the golfer exactly what is entailed to properly cock and uncock his wrists during a proper golf swing, and the chipping and putting stance the golfer needs to assume to increase his accuracy.

The foregoing description and drawings will suggest other embodiments and variations within the scope of the claims to those skilled in the art, all of which are intended to be included in the spirit of the invention as herein set forth.

What is claimed is:

1. A golf swing aid for use in practicing golf with a golf club having a shaft with a circular cross section comprising:

an intermediate shank portion having a concave undersurface for positive engagement with said shaft;

first and second generally semi-circular curved portions being connected to each other and to opposed ends of said intermediate shank portion, and lying in a common plane passing through said shank portion;

an extending tab portion connected intermediate to said first and second curved portions and extending away from said intermediate shank portion wherein said extending tab portion lies in the same plane as said first and second curved portions and said intermediate shank portion; and said first and second curved members having oppositely disposed ends extending inwardly to said extended tab portion and flaring outwardly from said intermediate shank portion to define an opening of sufficient size to receive a golfer's upper arms so that said curved portions engage snugly against and restrict movement of the outer sides of the golfer's upper arms while executing a golf putting stroke.

2. A golf swing aid according to claim 1, wherein said extending tab portion has an opening shaped as an arrow and defines a direction parallel to said intermediate shank portion and lies in the plane parallel to the plane of said intermediate shank portion.

3. A golf swing aid according to claim 2, wherein said arrow defines an aligning means indicating the best stable position for said golfer to use said golf club.

4. A golf swing aid according to claim 3, wherein said arrow in use with a straight edge on the ground provides further alignment means, so said golfer can align his shot to put a golf ball into a hole.

* * * * *